US006761062B2

(12) United States Patent
Shapiro

(10) Patent No.: US 6,761,062 B2
(45) Date of Patent: Jul. 13, 2004

(54) BOREHOLE TESTING SYSTEM

(76) Inventor: Allen M. Shapiro, U.S. Geological Survey, Water Resources Division, Branch of Regional Research Eastern Region, 12201 Sunrise Valley Dr., MS:, 431 Reston, VA (US) 20192

( * ) Notice: Subject to any disclaimer, the term of this patent is extended or adjusted under 35 U.S.C. 154(b) by 0 days.

(21) Appl. No.: 09/729,791

(22) Filed: Dec. 6, 2000

(65) Prior Publication Data

US 2002/0066308 A1 Jun. 6, 2002

(51) Int. Cl.[7] ..... E21B 47/10; E21B 27/00
(52) U.S. Cl. ..... 73/152.41; 166/169
(58) Field of Search ..... 73/152.39, 152.21, 73/152.02, 152.41, 152.47; 166/250.09, 169

(56) References Cited

U.S. PATENT DOCUMENTS 4,392,376 A * 7/1983 Lagus et al. ..... 73/152.41
4,553,429 A * 11/1985 Evans et al. ..... 73/152.21
4,832,121 A * 5/1989 Anderson ..... 166/250.09
5,138,875 A * 8/1992 Booer ..... 73/152.47
5,551,287 A * 9/1996 Maute et al. ..... 73/152.02
6,302,200 B1 * 10/2001 Patton et al. ..... 166/169

* cited by examiner

*Primary Examiner*—Hezron Williams
*Assistant Examiner*—Jay L Politzer

(57) ABSTRACT

A self-contained, transportable system for conducting any of hydrologic tests or water sampling techniques without the need for retooling or readjusting the system. The system includes a borehole unit for conducting the tests in a borehole, and a data acquisition unit for monitoring and recording the results of the tests. The borehole unit includes, connected in serial relation, a pair of borehole packers for forcing the unit in place in the borehole, several pressure transducers for obtaining hydraulic measurements, a pump located between the borehole packers for withdrawing fluid and a fluid injector for injecting fluid. The data-acquisition system includes flow meters for monitoring fluid injection and fluid withdrawals, a data-acquisition module for monitoring a fluid pressure from the pressure transducers, power source and a computer interface. The overall system includes a pressure manifold for supplying gas to the packers, transducer and injectors, a hand-held electric water-level sounder, and a pressure regulator. The system can be used to measure ambient hydraulic pressure, fluid injection or fluid withdrawal tests for inferring formation properties and tracer tests for inferring properties of the formation controlling chemical migration. Additionally, the system can be used in contaminated groundwater environments because it is easy to decontaminate.

20 Claims, 5 Drawing Sheets

BOREHOLE TESTING SYSTEM

FIELD OF THE INVENTION

The invention relates to subsurface hydrology and engineering geology and, in general, the invention concerns a borehole testing apparatus for conducting hydrologic tests and researching the mechanisms controlling fluid movement and chemical transport in fractured rock aquifers.

DESCRIPTION OF THE RELATED ART

Study of the subsurface beneath the ground to identify the quantity and quality of ground water and characterize the movement of contaminants in the subsurface is a concern of many Federal and state regulatory agencies which are responsible for ground-water resources and for the oversight of ground-water remediation. Such study is needed to ensure that technically feasible regulatory decisions can be made. It is also of interest to government agencies responsible for remediation of property. For example, the U.S. Geological Survey routinely conducts cooperative investigations with other federal agencies and state and local governments involving the characterization of ground-water quantity and quality and the migration of contaminants in the subsurface, requiring the hydrologic testing and the collection of water samples from subsurface boreholes for geochemical analysis. Furthermore, many private engineering companies are engaged in similar types of site characterization for corporate clients engaged in the remediation of contaminated ground water.

Hydrologic testing and the collection of water samples for geochemical analysis have often been conducted using downhole equipment to isolate and test water in a discrete interval in a borehole. Individual components used in borehole testing and geochemical analysis, such as pumps, borehole packers, pressure transducers and various types of data acquisition equipment are available from a number of manufacturers.

Commonly, a borehole is drilled into the ground to allow access to the subsurface and testing equipment is lowered into the borehole. In most cases, the borehole equipment is constructed for a specific type of test or geochemical sampling and is typically fixed in place. However, a site may require more than a single type of test to adequately study the site. Further, the physical dimensions of the borehole equipment and the need for various peripheral components at land surface for data collection make such borehole testing equipment cumbersome and not readily transportable from site to site. This is disadvantageous because testing at more than a single borehole, sometimes a series of boreholes, is frequently necessary to characterize a ground-water site.

Therefore, there is a serious need in the art for an integrated borehole testing equipment design which is capable of isolating and testing a discrete interval of a borehole, and which is transportable, easily assembled, and capable of conducting multiple types of hydrologic tests as well as collecting water samples for geochemical analysis. Moreover, with the increased need in recent years for remediation of contaminated ground water, there is an increased interest in equipment which can conduct testing of contaminated ground water. However, the application of downhole equipment capable at isolating a discrete interval of a borehole for hydrologic testing or geochemical sampling at sites having contaminated ground water has not been actively considered because of problems, such as the contamination of the downhole equipment. Therefore, there is a further need in the art for testing equipment that can operate in contaminated ground-water sites.

Prior art of interest includes U.S. Pat. Nos. 5,934,375 (Peterson); 4,435,843 (Jageler); and 3,799,733 (Ringgenberg). The Peterson patent discloses a deep well system for obtaining artesian samples. The system comprises a borehole packer, a pump for withdrawing fluids, and a sample chamber for holding the fluids. A portion of the sample is discharged to flush the system, but the system does not discharge tracer fluid into the borehole or extract tracer fluid to estimate properties of the subsurface At affecting chemical migration therein. The Jageler patent discloses an apparatus for testing borehole fluids. The apparatus comprises a packer, an electrical section, a hydraulic section, and a mechanical section. The Ringgenberg patent discloses a system for servicing a well, taking fluid measurements, and taking fluid samples. The system comprises a borehole packer, a pump for withdrawing fluids, a sampling chamber for holding fluids, and pressure and temperature recording devices.

The borehole and data acquisition equipment disclosed in these patents do not address the needs for multiple testing at multiple sites, some of which may be contaminated. The equipment is not transportable, easily assembled, capable of conducting multiple types of hydrologic tests or performing geochemical sampling, nor is the equipment suitable for use at sites having contaminated ground water.

SUMMARY OF THE INVENTION

In accordance with the invention, a self-contained, transportable borehole system for conducting hydrologic tests or water sampling is provided which meets the needs described above and overcomes other problems associated with the prior art.

The borehole system has a borehole unit for conducting the hydrologic tests in a borehole, and a data acquisition unit for monitoring and recording the results of the tests. The borehole unit comprises, housed in protective shrouds and connected together by union connectors in serial relation, first and second borehole packers, a plurality of pressure transducers for obtaining pressure measurements, a pump unit, located between the borehole packers, for withdrawing fluid from a test interval, and an injection unit, located between the borehole packers, for injecting fluid into a test interval. The data-acquisition unit is comprised of at least one flow meter for monitoring fluid injection by the injection unit, at least one flow meter for monitoring fluid withdrawal by the pump unit, and a data-acquisition module for providing a digital record of flow meter readings and pressure measurements.

Advantageously, the data acquisition unit further comprises rechargeable batteries for providing power for the unit and for the flow meters.

Preferably, the borehole system has a single, portable pressure source and a pressure manifold for supplying gas to operate the injector unit, to operate the transducer, and to inflate the borehole packers. Advantageously, a fluid reservoir is connected to both the fluid injection unit and to a pressure regulator which regulates the air pressure applied to the fluid reservoir during fluid injection.

The borehole system may be used for conducting measurements of ambient hydraulic pressure, fluid injection or fluid withdrawal tests for inferring formation properties, or tracer tests for inferring properties of the formation controlling chemical migration.

Preferably, the pressure transducers include an upper transducer that measures hydraulic pressure above a test interval, an intermediate transducer that measures hydraulic pressures within the test interval, and a lower transducer for measuring the hydraulic pressure below the test interval. Further, the intermediate and lower transducers are preferably located above the borehole packers.

Advantageously, the data-acquisition unit electronically stores digital records of collected data and displays the data as it is collected.

Preferably, transducer cables and pump cables are prewired in the borehole unit, and the union connectors between segments comprise screw-disconnect union ball joints.

The borehole system is very simple to decontaminate after use in contaminated ground-water or other sources of contamination, and to this end, there are provided connecting tubes made of stainless steel, polytetrafluoroethylene tubing for transporting water within the system, stainless-steel fittings, a stainless-steel pump and a polytetrafluoroethylene coated pump cable.

DESCRIPTION OF THE PREFERRED EMBODIMENTS

As indicated above, the invention concerns a self-contained, transportable apparatus for conducting hydrologic tests and collecting of water samples from a hydraulically isolated interval of a borehole. The apparatus is basically comprised of a borehole unit 10, shown in its entirety in FIG. 1 and in part in FIGS. 2–3, and data-acquisition unit 64 (at the land surface), and is specifically constructed so as to increase portability thereof. As described below, the borehole system can be quickly and easily configured to collect water samples for geochemical analysis and multiple types of hydrologic tests to infer properties of the subsurface that describe fluid movement and chemical migration. The types of hydrologic tests that can be conducted includes 1) measurement of ambient hydraulic head, 2) hydraulic tests using fluid injection or fluid withdrawals or some combination of both to infer formation properties, and 3) tracer tests to infer properties of the formation that control chemical migration, wherein a traced fluid is injected and later withdrawn from the subsurface formation.

Figure 1:
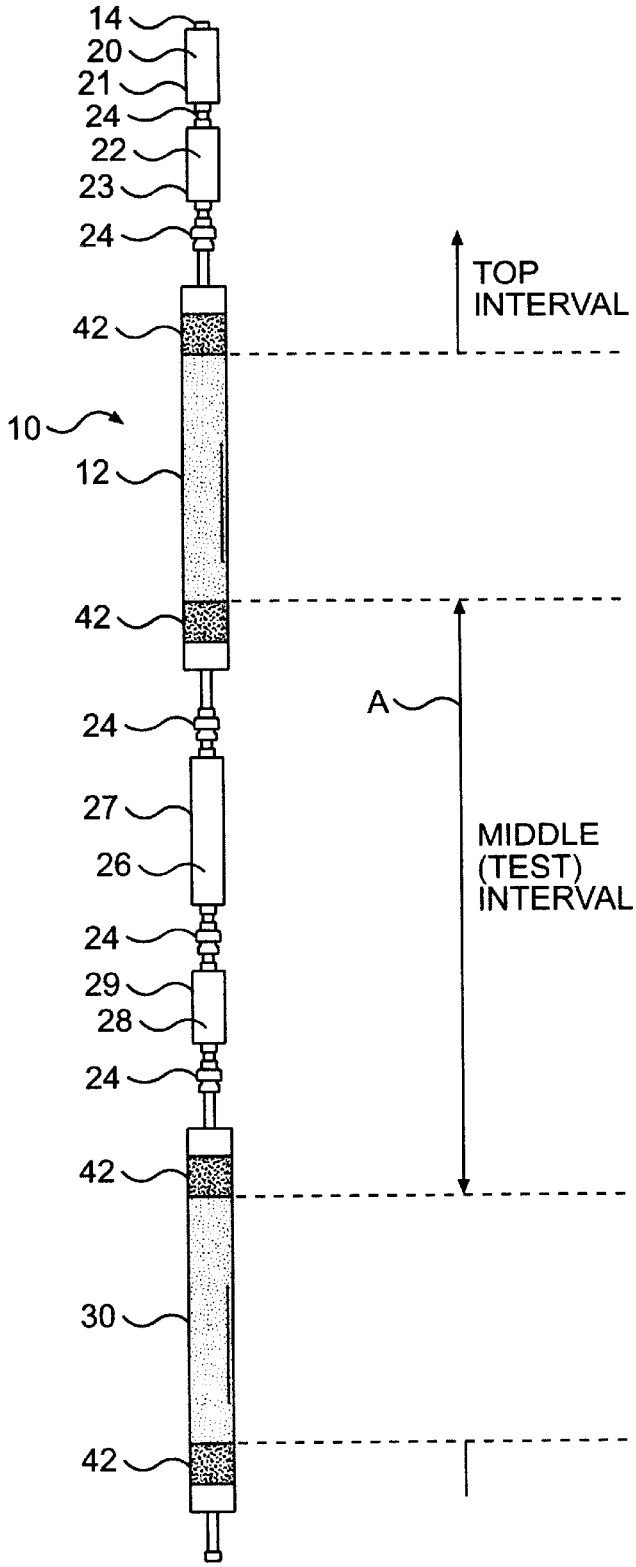
FIG. 1 is a side elevational view of the borehole system.
Figure 2:
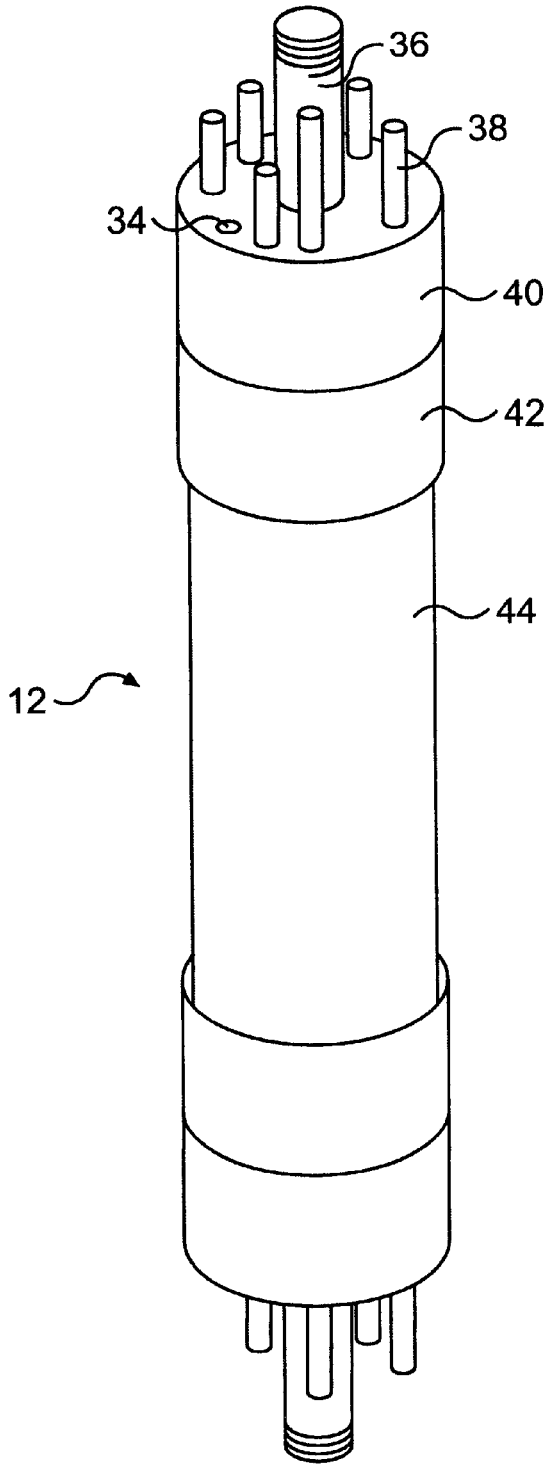
FIG. 2 is a side elevational view of the top borehole packer.
Figure 3:
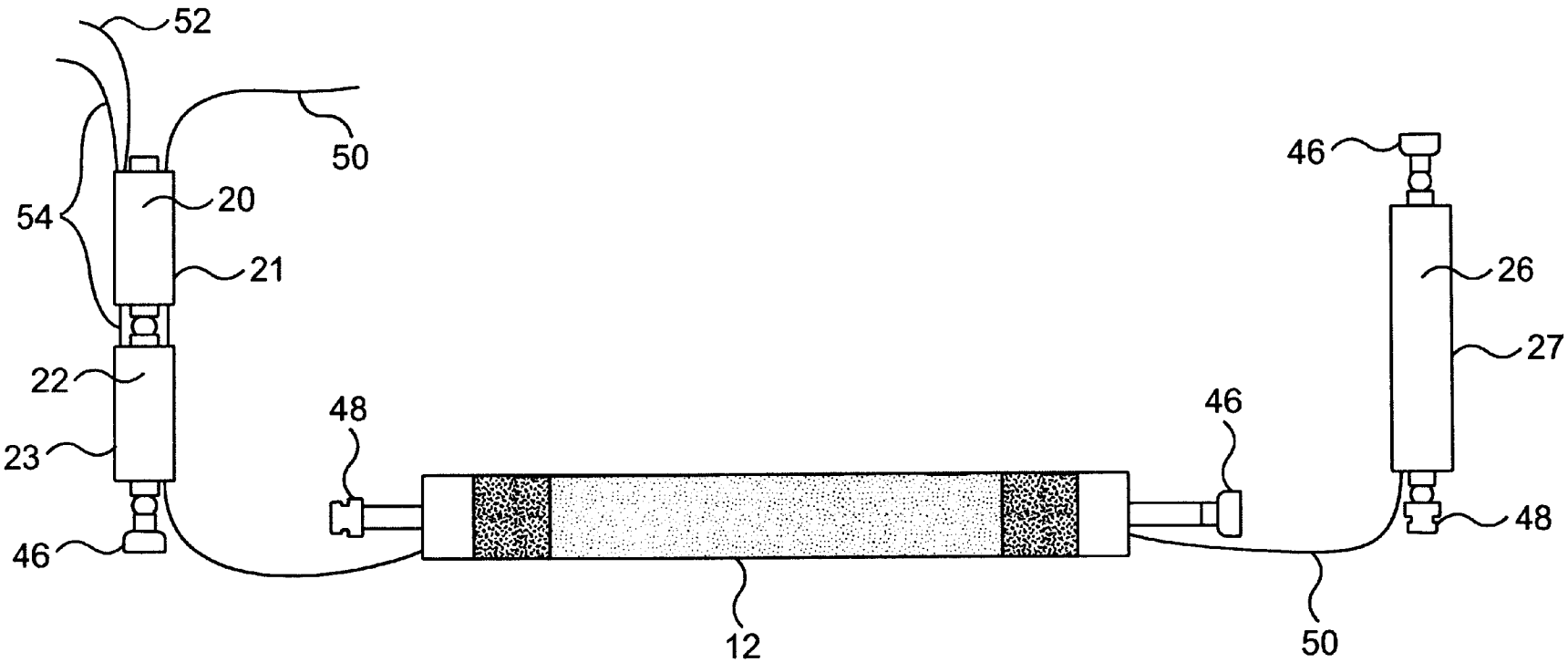
FIG. 3 is a side elevational view of a portion of the borehole apparatus in a disassembled state.

Referring to FIGS. 1 to 3, the borehole unit 10 can be lowered down a borehole using a cable and winch (not shown), or with steel pipe (not shown) connected to a female pipe thread 14 at the top of equipment 10. This manner of lowering the borehole unit 10 eliminates the need for cranes of other bulky lowering apparatus. The components of the borehole unit 10 include two pneumatic borehole packers, a top packer 12 and a bottom packer 30 for isolating a discrete (test) interval in the borehole, an electrically powered pump unit 26 for withdrawing water from between the two packers 12, 30, a downhole injection valve unit 28 for the injection of fluid between the two packers 12, 30, three pressure transducers, two of which are denoted 20 and 22 and a further top transducer (not shown) for monitoring hydraulic head in the test interval, as well as above and below the test interval. The apparatus also has corresponding shrouds 21, 23, 27, 29 to protect the associated borehole equipment as described below.

The pair of packers 12 and 30 of the borehole unit 10 are pneumatic packers. In the exemplary embodiment under consideration, the packers 12 and 30 are 4.75-inch-diameter packers which are suitable for 6-inch diameter boreholes, but which can be adjusted to boreholes of greater or lesser diameter. Packers 12 and 30 are substantially identical and thus only packer 12 will be described. The constructional details of packer 12 are shown in FIG. 2 and, as illustrated, packer 12 includes a central inflatable rubber bladder 44. Once lowered into the borehole, the packers 12 and 30, inflatable rubber bladder 44 is pressurized with compressed gas through an inflation port 34 in the packer head 40, to increase the diameter of the bladder 44. The bladder 44 seals against the borehole wall because of the increased diameter thereof. The section of the borehole between the packers 12 and 30 is isolated for sampling and testing purposes. This isolated section is called the "middle" or "test" interval. The test interval, which is indicated by arrow A, is defined as the distance from the bottom of the inflatable bladder of the top packer 12 to top of the bladder on the bottom packer 30.

The top packer 12 also has feed-through tubes 38 for testing and sample collection which are continuous and extend through the packer 12 and allow access below the packer 12 into the borehole. The bottom packer 30 has a pair of stainless-steel feedthrough tubes (not shown). The tubes are attached to the head of the packer 30 using pressure tight fittings.

Referring again to FIG. 1, the pump unit or section 26 is used to transfer water from the isolated borehole section to the surface. The pump unit 26 comprises an electric pump protected inside a pump shroud 27. The pump is controlled by a pump cable 50 extending through the top packer 12 to the surface and a pump-control box (not shown) for operating the pump. Water travels up through a water outlet from the pump of pump unit 26 that is connected to tubing 38 extending through the top packer 12 and up to the surface.

The pump shroud 27 is a hollow metal cylinder with removable top and bottom plates (not shown). The top and bottom plates of the shroud have holes therein accommodate tubing 38 to allow water movement and provide access for other tubing and wires. The top and bottom plates of the shroud have threaded fittings to facilitate ease of connections to other components of the downhole equipment.

Electric pumps with different capacities can be used in the multifunction borehole testing apparatus of the invention. Further, other types of pumps (other than electric pumps) can be used in the construction of the borehole equipment. For example, an air-actuated piston pump has been successfully used with borehole packers. The choice of the pump to be used will depend in part on the hydrologic conditions encountered in the formation.

The fluid injection unit, or fluid injector 28, is used for transferring water from the surface into the isolated test interval of the borehole. The fluid-injector 28 comprises an air-actuated fluid-injection valve housed in a shroud 29. The fluid-injection shroud 29 is designed similarly to the pump shroud 27 discussed previously. Two stainless-steel tubes (not shown) extend from the shroud 27. One tube is connected through the top packer 12. A source of compressed gas 56 (see FIG. 4) actuates the valve piston of injector 28 (not shown). The valve of unit 28 opens when an appropriate pressure of compressed gas is applied to the piston housed in the valve. The compressed gas moves from the compressed gas source 56, through a stainless steel tube (not shown) to the valve piston. With the valve of unit 28 open, water from a fluid reservoir 72 (see FIG. 5) at the surface travels through from the fluid reservoir 72 through tubing that extends through the top packer 12 and into the test interval. Reducing the pressure applied to the air actuated valve unit 28, closes the valve of unit 28 and stops injection of water.

The pressure transducers (shown at 20 and 22 with top transducer not shown) are included in the multifunction borehole testing apparatus to record hydraulic test results. The top transducer (not shown) monitors fluid pressure responses above the top packer 12; the middle interval (test) transducer 20 monitors fluid pressure in the test interval; and the bottom interval transducer 22 monitors fluid pressure below the bottom packer 30. The middle transducer 20 provides hydraulic information directly concerning the test interval indicated by arrow A. The transducers above and below the test interval A provide hydraulic information about possible hydraulic connections between the test interval A and other sections of the borehole during geochemical sampling or hydrologic testing. The transducers can be vented to the atmosphere so transducer readings are relative to atmospheric pressure. In the alternative, absolute transducers not vented to the atmosphere can be used, depending upon test conditions and other factors. Manual measurements of water levels are used to check the calibration and determine the appropriate offset to be applied in converting the electrical output of the transducer to hydraulic pressure.

The transducer used to monitor fluid pressure above the top packer 12 is not connected to the downhole equipment, but rather is a separate unit and is lowered below the water in the borehole above the top packer 12 after the other downhole equipment has been put in place.

The middle and bottom zone transducers 20 and 22 monitor fluid pressure between the two packers 12 and 30 and below the bottom packer 30, respectively, by connecting the ends of the transducers 20 and 22 with the sensors (not shown) to respective tubes (not shown) that extend through the associated packer(s) and open in the interval that is to be monitored. Electrical transducer cables 52 and 54 extend from the transducers 20 and 22, respectively, to the land surface for providing information to a data acquisition panel 64.

The transducers 20 and 22 used to monitor changes in fluid pressure in the middle interval A and below the bottom borehole packer 30, are housed in respective transducer shrouds 21 and 23 which are attached above the top packer. The shrouds that house these transducers are similar to the shrouds 27 and 29 that house the pump of the pump unit 26 and the fluid-injection valve of valve unit 28.

Placing the transducer sensors above the top packer 12, rather than placing the transducer directly in the test interval or below the bottom packer 30, is advantageous in the assembly of the downhole equipment. In this regard, transducer cables do not have to be routed through the top and bottom packers 12 and 30. Because the transducers are designed to be outside the test zone, the length of the test interval (distance between borehole packers) can be adjusted without having to adjust transducer cables.

The borehole components are connected together using union ball joints 24. The union ball joint 24 allows components to be connected together without rotating the borehole components. Rotating the threaded nut (not shown) on the union ball joint 24 connects two borehole components together. This type of fitting for connecting borehole components, i.e., one that provides for a simple rotation of the parts to provide assembly, allows the pump and transducer cables 50, 52 and 54 (see FIG. 3) to be fed through the borehole components during shipping which reduces the time needed to assemble the equipment prior to use. The transducer cables 52 and 54 and the pump cables 50 are prewired in the downhole equipment and union ball joints 24 are used to connect sections of the equipment deployed downhole to allow rapid assembly of the downhole equipment.

It will be appreciated that the length of the test interval can be easily increased by adding a length of steel pipe immediately above the bottom packer. The length of the test interval can be decreased by using shorter pump and fluid injection shrouds. Moreover, the construction of the multifunction borehole testing system of the invention can be adapted for other borehole diameters and maximum depths by using different sizes of borehole packers and downhole cables.

The borehole unit can be lowered using a winch and a cable (not shown) attached to a swivel-eye hoisting plug (not shown) or, alternatively, the borehole equipment can be lowered downhole using steel pipe (not shown) attached to the top of the transducer shroud 21.

Once the borehole unit has been lowered in the borehole to the desired location for testing, the top transducer cable (not shown) is lowered in the borehole so that the sensor is below the water surface. A manual water level measurement is then taken to calculate the offsets for the three pressure transducers in converting the voltage output from the transducers to values of hydraulic head. The top and bottom borehole packers 12 and 30 are then inflated with pressurized gas applied through the pressure manifold 59 (FIG. 4) to isolate the test interval. Once the packers 12 and 30 are inflated to a point where the bladders 44 (FIG. 2) seal against the borehole walls, the test interval is hydraulically isolated from the top and bottom intervals. At this juncture, a number of different hydrologic tests or geochemical sampling, can be conducted.

The borehole unit is constructed to accommodate the pump unit 26 and fluid injection unit 28 simultaneously, which makes it possible to perform various types of hydrologic tests as well as collect water samples for geochemical analysis without removing the equipment from the borehole for reconfiguration.

Water from the pump unit 26 is routed through a designated flow meter 68*c* to collect information on flow rates during geochemical sampling or hydrologic tests (see FIG. 5) that require fluid withdrawals from the borehole. Each flow meter 68*c* is calibrated over the anticipated range associated with the pump. Similarly, monitoring flow rates during fluid injection in the test interval is accomplished by routing water from a fluid reservoir 72 to a panel of further flow meters 68*a* and 68*b* via a fluid injection flow meter manifold 70 (FIG. 5).

Additionally, the flow meters and pressure transducers can be chosen such that their calibrated range is consistent with the anticipated hydrologic conditions.

Figure 4:
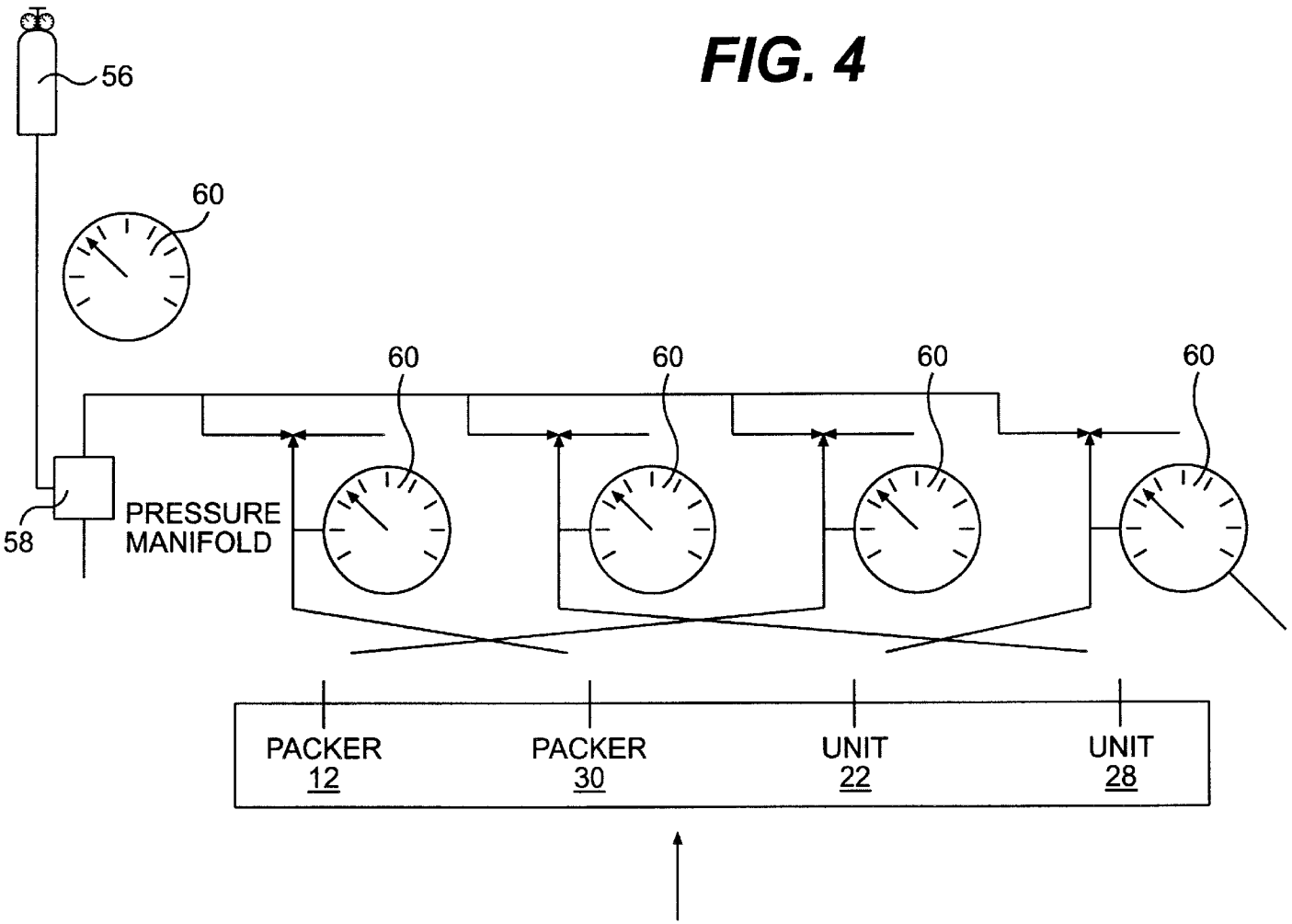
FIG. 4 is a schematic view of the air pressure delivery system.
Figure 5:
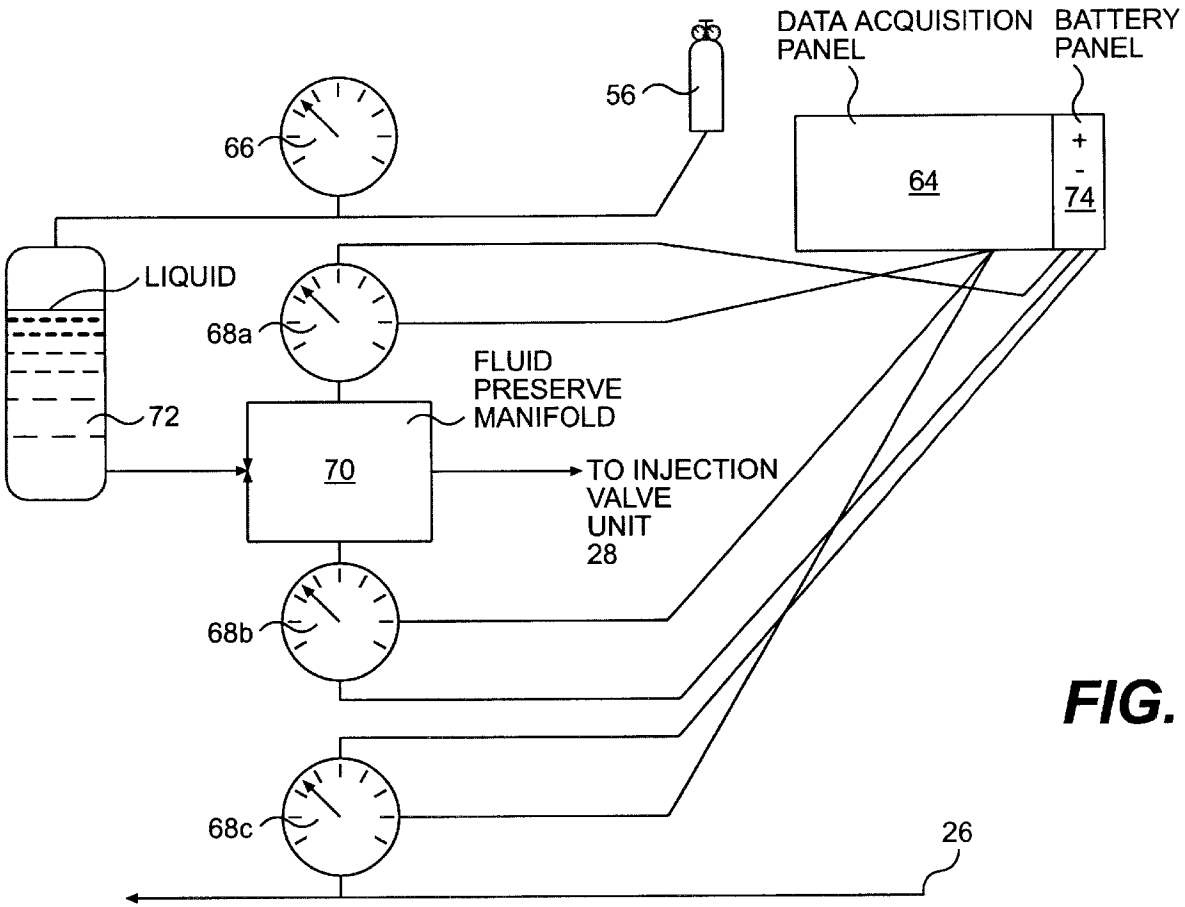
FIG. 5 is a schematic view of the flow meter and data acquisition system.

Turning to FIGS. 4 and 5, data from pressure transducers and rates of fluid withdrawal or injection must be collected to interpret hydrologic data collected during geochemical sampling or hydrologic testing. The borehole equipment 10 is integrated with data acquisition equipment 64 at the surface to measure and record downhole fluid pressures at three locations in the borehole, and flow rates during fluid injection or pumping. As indicated above, a single flow meter 68*c* monitors fluid withdrawals during pumping while two further flow meters 68*a* and 68*b* monitor fluid-injection rates.

More than two flow meters can be used, depending on the range of fluid-injection rates anticipated (additional flow meters not shown) to monitor fluid injection. If more than two flow meters are used for fluid-injection testing, the fluid injection flow meter manifold 70 is altered to accommodate additional flow meters.

Similarly, additional flow meters having different ranges can be used to monitor pumping (additional flow meters not shown). If additional flow meters are used to monitor pumping, the flow meters for pumping is placed in a manifold to route the discharge from the pump to the flow meters, accordingly.

A battery panel 74 powers the data-collection devices. A data-collection panel 64 retains a digital record of fluid pressures and the flow meter readings. Software is used to provide interfacing with the data collection panel 64 with a laptop computer (not shown) for storage of the digital data and for visually displaying the data as it is collected. Data-collection software for use on an IBM compatible laptop computer provides the interface with the data-acquisition components.

The data-acquisition panel 64 is prewired to interface with the top, middle and bottom pressure transducers described above, the flow meters 68*a*, 68*b* and 68*c*, and the batteries 74. The data-acquisition panel 64 is programmed to use an applied voltage to monitor the fluid pressure applied at the transducer sensor (not shown) of the transducers. The data-acquisition panel 64 stores this data at prescribed intervals, and is programmed to process the data and convert the response voltage at the transducer sensor into hydraulic pressure readings. Similarly, the data-acquisition panel 64 is programmed to measure the frequency of the driven impellers (not shown) of the conventional flow meters 68*a*, 68*b* and 68*c* and convert the impeller frequency to flow rates. The software automatically downloads the data (pressure transducer and flow meter readings) to files on the laptop computer at regular intervals. Several types of data acquisition devices and software that interface with pressure transducers and flow meters can be used.

To provide a borehole testing system that is self-contained and, therefore, transportable, additional equipment is included in the multifunction borehole testing system of the invention. This equipment includes a pressure manifold 59, a hand-held electric water-level sounder (not shown), and a pressure regulator 66. As indicated above, a swivel-eye hoisting plug (not shown) is preferably used so that a simple winch and cable may be used to lower the borehole apparatus 10 downhole.

The pneumatic packers 12 and 30, the transducer valves of transducers 20 and 22 and fluid-injection valve of the injection unit 28 operate with compressed gases. The pressure manifold 59 is used to distribute compressed gas from a single portable pressure source 56, such as a gas cylinder, at the surface to the downhole equipment as needed. The manifold 59 has separate outlets to distribute compressed gas such as nitrogen from a single source. The pressure applied to the borehole unit can be read on a series of pressure gauges 60 as shown in FIG. 4.

The air-actuated valve (not shown) attached to each pressure transducer 20, 22 is pressurized to open the valve and allow air to escape from the tubing (not shown) that extends through the packers 12 and 30 to the test interval and the bottom interval. This insures that fluid is in contact with the pressure sensor (not shown) rather than air. Once air has been purged from this tubing, the valves are closed by reducing the pressure applied. This operation is conducted prior to initiating any of the tests in the borehole.

The pressure regulator 66 regulates the air pressure applied to the water surface of the fluid reservoir 72 during fluid injection. The application of a pressure above atmospheric pressure to the water surface of a fluid reservoir during fluid injection is advantageous in many types of hydrologic tests. The inlet of the regulator 66 is connected to the source of compressed gas 56, (which, as indicated above, can be a cylinder of compressed gas or an air compressor) and the outlet is connected above the water level in the fluid reservoir 72.

A water-level indicator (not shown) is used for taking manual measurements of depth of water in the borehole. The depth measurements provide check measurements for measurements of hydraulic pressure from the three transducers including 20 and 22.

The borehole unit 10 is constructed for ease in shipping and assembly and can be easily and rapidly assembled prior to its deployment downhole. The borehole unit components, data-acquisition components and additional equipment are designed to fit in one or more crates for shipping.

The borehole unit 10 of the multifunction borehole testing apparatus is constructed for application at sites having contaminated formation waters. The latter may require decontamination of the equipment used in the boreholes. Conducting hydrologic tests or geochemical sampling at sites of contaminated ground water requires cleaning of borehole equipment that comes in contact with ground water. The downhole equipment of the invention and the materials used in the construction of downhole equipment of the invention are capable of being successfully cleaned. The downhole equipment and the material of construction are also such as to be applicable at sites having contaminated formation waters. In this regard, the borehole components and associated tubing are, as described above, easily disconnected to facilitate decontamination of individual components of the borehole equipment. The entire borehole apparatus 10 can also be decontaminated if facilities are available to handle equipment of this length.

For geochemical sampling or hydrologic testing by fluid withdrawal, water from the pump unit 26 is routed through a stainless-steel tube (not shown) that extends through the top borehole packer 12. This stainless steel tube can either be decontaminated, or replaced, in the top borehole packer 12. Other tubes (not shown) in both the top and bottom borehole packers are also made of stainless steel. Additionally, stainless-steel fittings are used to make all downhole connections.

Teflon tubing is preferably used to pipe water to land surface from the pump unit 26, and Teflon tubing is also used to make other connections (e.g., to inflate borehole packers 12 and 30, operate downhole valves and serve as a fluid injection line to the fluid injection unit 28).

The inflatable bladders 44 and flexible collars 42 on the top and bottom packers can be replaced if decontamination is not successful. Finally, a stainless-steel pump with a Teflon coated pump cable is used to withdraw water from the test interval.

Considering some of the tests that can be conducted using the system of the invention, these tests include:

Measuring Ambient Hydraulic Head

With the top and bottom packers 12 and 30 inflated as discussed above, the ambient hydraulic head in the test interval A, and above and below the test interval, can be measured once it has reached equilibrium.

Geochemical Sampling

With the top and bottom packers 12 and 30 inflated as discussed above, geochemical samples are collected from the test interval A by operating the pump located in the test interval.

Hydraulic Testing by Fluid Withdrawal

Several types of hydraulic tests have been developed to estimate the hydraulic properties of the subsurface by analyzing fluid pressure responses to fluid withdrawals from the formation. Hydraulic tests conducted using fluid withdrawals are conducted after the packers have been inflated. The pump is operated in accordance with a given test design and the pumping rate and the fluid pressure responses are monitored. These types of tests include pumping at a constant rate, pumping cyclically, and pumping at a rate that is maintained constant over a period of time and then increased to a new rate that is again maintained constant (also referred to as a step-drawdown test). The fluid pressure responses in the test interval above and below the test interval, during pumping and after the end of pumping, can be interpreted to estimate hydraulic properties of the formation.

Hydraulic Testing by Fluid Injection

Conversely, hydraulic tests that inject water into the test interval are also often used to estimate the hydraulic properties of a formation. There are several types of tests that have been developed using fluid injection and associated fluid pressure responses to estimate the hydraulic properties of the formation. These tests include injecting fluid at a constant rate, cyclical fluid injection and injecting a small volume of fluid over short period of time (also referred to as slug test).

Fluid-injection tests can be conducted in the test interval using the fluid-injection unit 28 after inflating the top and bottom packers 12 and 30. The fluid injection valve of unit 28 is pressurized through the pressure manifold 59 at land surface. The pressurization opens the valve and allows water from the fluid reservoir at the surface to enter the test interval. The fluid pressures of the transducers 20, 22 and injection rates are monitored with a flow meter during and after the injection.

Tracer Testing by Fluid Injection Followed by Pumping

In a tracer test, a fluid is injected that is tagged with a chemical constituent into the subsurface and then its behavior is monitored to estimate properties of the subsurface that affect chemical migration. Tracer tests using the same borehole to inject and withdraw the tagged fluid are often referred to as "push-pull" tests. The test is performed by first injecting a fluid from a fluid reservoir at land surface. At some later time the injection is stopped and the downhole pump withdraws the fluid from the formation for analysis of the chemical constituent used in the injection fluid. The procedures above for conducing fluid injection and fluid withdrawal are applied in conducting this type of test.

Although the invention has been described above in relation to a preferred embodiment thereof, it will be readily understood by those skilled in the art that variations and modifications can be effected without departing from the scope and spirit of the invention.

What is claimed is:

1. A self-contained, transportable system for conducting hydrologic tests or water samplings, said system comprising:

a borehole unit for conducting a plurality of said tests in a borehole; and a data acquisition unit for monitoring and recording the results of said tests;

said borehole unit comprising, housed in protective shrouds and connected together by union connectors in serial relation:

first and second borehole packers;

a plurality of pressure transducers for obtaining pressure measurements;

a pump unit, located between said borehole packers, for withdrawing fluid from a test interval and for pumping the fluid to land surface to enable geochemical analysis thereof;

an injection unit, located between said borehole packers, for injecting fluid into a test interval; and said data-acquisition unit comprising:

at least one flow meter for monitoring fluid injection by said injection unit;

at least one flow meter for monitoring fluid withdrawal by said pump unit; and a data-acquisition module for providing a digital record of flow meter readings and said pressure measurements.

2. A system according to claim 1, wherein said data acquisition unit further comprises rechargeable batteries for providing power for said data-acquisition module and said flow meters.

3. A system according to claim 1, wherein said system further comprises a single, portable pressure source and a pressure manifold for supplying gas from said single pressure source for operating said injection unit, for operating said transducers, and for inflating said borehole packers.

4. A system according to claim 1, wherein said system further comprises a fluid reservoir connected to the fluid injection unit and a pressure regulator for regulating air pressure applied to the fluid reservoir during fluid injection.

5. A system according to claim 1, wherein said system is used for conducting measurements of ambient hydraulic pressure.

6. A system according to claim 1, wherein said system is used for fluid injection or fluid withdrawal tests for inferring formation properties.

7. A system according to claim 1, wherein said system is used for tracer tests for inferring properties of the formation controlling chemical migration.

8. A system according to claim 1, wherein said data-acquisition module electronically stores digital records of collected data and visually displays said data as said data is collected.

9. A system according to claim 1, wherein transducer cables for said transducers and pump cables for said pump unit are prewired in the borehole unit.

10. A system according to claim 1, wherein said union connectors comprise screw-disconnect union ball joints.

11. A system according to claim 1, wherein said system includes connecting tubes connected to the borehole packers and said connecting tubes are comprised of stainless steel.

12. A system according to claim 1, wherein said system further comprises polytetrafluoroethylene tubing for transporting water within the system.

13. A system according to claim 1, wherein said borehole unit includes stainless-steel fittings.

14. A system according to claim 1, wherein the pump unit comprises a stainless-steel pump and a polytetrafluoroethylene coated pump cable.

15. A system according to claim 1, wherein said plurality of pressure transducers further comprises an upper transducer for measuring hydraulic pressure above a test interval, an intermediate transducer for measuring hydraulic pressures within said test interval, and a lower transducer for measuring said hydraulic pressure below said test interval, and wherein said intermediate and lower transducers are located above the borehole packers.

16. A self-contained, transportable system for conducting hydrologic tests or water samplings, said system comprising:

a borehole unit for conducting a plurality of said tests in a borehole; and a data acquisition unit for monitoring and recording the results of said tests;

said borehole unit comprising:

an upper borehole packer and a lower borehole packer disposed in spaced relation in the borehole so as to define a test interval;

at least one pressure transducer, located above the upper borehole packer and connected to the test interval, for obtaining pressure measurements within the test interval; and a pump unit, located between said borehole packers, for withdrawing fluid from the test interval; and said data-acquisition unit comprising:

at least one flow meter for monitoring fluid withdrawal by said pump unit; and a data-acquisition module for providing a digital record of flow meter readings and said pressure measurements.

17. A system according to claim 16 wherein said pump unit comprises a pump for, when activated, continuously withdrawing fluid from the test interval.

18. A system according to claim 16 wherein said pump unit comprises a pump for pumping fluid to land surface to enable geochemical analysis thereof.

19. A system according to claim 16 wherein said pressure transducer comprises a transducer unit including a compressed gas operated transducer valve.

20. A system according to claim 16, wherein said union connectors comprise screw-disconnect union ball joints.

* * * * *